US009146046B2

(12) United States Patent
Chae et al.

(10) Patent No.: US 9,146,046 B2
(45) Date of Patent: Sep. 29, 2015

(54) REFRIGERATOR AND DRIVING METHOD THEREOF

(75) Inventors: Sunam Chae, Seoul (KR); Juyeong Heo, Seoul (KR); Sung Jhee, Seoul (KR); Chanho Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 976 days.

(21) Appl. No.: 13/190,826

(22) Filed: Jul. 26, 2011

(65) Prior Publication Data

US 2012/0023978 A1 Feb. 2, 2012

(30) Foreign Application Priority Data

Jul. 28, 2010 (KR) ..... 10-2010-0073045
Jul. 28, 2010 (KR) ..... 10-2010-0073047
Jul. 28, 2010 (KR) ..... 10-2010-0073048

(51) Int. Cl.

| | |
|---|---|
| ***F25B 1/10*** | (2006.01) |
| ***F25B 5/02*** | (2006.01) |
| ***F25B 31/00*** | (2006.01) |
| ***F25B 40/00*** | (2006.01) |
| ***F25B 41/04*** | (2006.01) |

(52) U.S. Cl.

CPC ... *F25B 1/10* (2013.01); *F25B 5/02* (2013.01); *F25B 31/004* (2013.01); *F25B 40/00* (2013.01); *F25B 41/04* (2013.01)

(58) Field of Classification Search

CPC ..... F25B 42/02; F25B 31/00; F25B 31/02; F25B 43/02; F25B 5/04; F25B 5/02; F25D 11/022; F25D 11/025; F04C 15/0088; F04C 15/0092; F04C 19/02; F04C 19/026

USPC ..... 62/442, 84, 192, 252, 441, 468, 470, 62/510

See application file for complete search history.

(56) References Cited

U.S. PATENT DOCUMENTS

| | | | | |
|---|---|---|---|---|
| 5,016,447 | A | 5/1991 | Lane et al. | |
| 5,236,311 | A * | 8/1993 | Lindstrom | 417/254 |
| 5,634,345 | A * | 6/1997 | Alsenz | 62/84 |

(Continued)

FOREIGN PATENT DOCUMENTS

| | | |
|---|---|---|
| EP | 1 336 804 A1 | 8/2003 |
| EP | 1 686 330 A2 | 8/2006 |

(Continued)

*Primary Examiner* — Frantz Jules
*Assistant Examiner* — Erik Mendoza-Wilkenfel
(74) *Attorney, Agent, or Firm* — Birch, Stewart, Kolasch & Birch, LLP

(57) ABSTRACT

A refrigerator and a driving method thereof are disclosed. A primary compressor and a secondary compressor can form independent cycles together with corresponding evaporators so as to reduce unnecessary power consumption. Also, a backflow prevention valve is installed between the primary and secondary compressors to prevent an increase in pressure of the secondary compressor, or an auxiliary heat exchanger is installed at the outlet side of a second evaporator with high temperature to allow heat exchange of an outlet side pipe of a first evaporator with low temperature so as to shift a load of a freezing chamber into a relatively large refrigerating chamber, thereby improving efficiency of the refrigerator. In addition, an oil separator or an oil collection pipe is installed at the outlet sides of the compressors or an oil balancing pipe and an oil balancing valve are installed between the compressors, so as to uniformly maintain an oil amount between the compressors.

6 Claims, 12 Drawing Sheets

(56) References Cited

U.S. PATENT DOCUMENTS

| | | | | |
|---|---|---|---|---|
| 8,122,735 | B2 * | 2/2012 | Sakitani et al. | 62/468 |
| 2002/0023459 | A1 * | 2/2002 | Kiyokawa et al. | 62/469 |
| 2002/0069654 | A1 * | 6/2002 | Doi et al. | 62/199 |
| 2006/0112724 | A1 * | 6/2006 | Chang et al. | 62/470 |
| 2006/0266074 | A1 | 11/2006 | Groll et al. | |
| 2007/0251264 | A1 * | 11/2007 | Jang et al. | 62/470 |
| 2007/0251265 | A1 | 11/2007 | Kurata et al. | |
| 2008/0098760 | A1 * | 5/2008 | Seefeldt | 62/238.7 |
| 2009/0120120 | A1 * | 5/2009 | Wiggs | 62/260 |
| 2009/0229300 | A1 * | 9/2009 | Fujimoto et al. | 62/470 |

FOREIGN PATENT DOCUMENTS

| | | | | |
|---|---|---|---|---|
| EP | 1 707 900 | A1 | | 10/2006 |
| EP | 2 012 075 | A1 | | 1/2009 |
| EP | 2 196 748 | A2 | | 6/2010 |
| JP | 4-263746 | A | | 9/1992 |
| JP | 9-300940 | A | | 11/1997 |
| JP | 2000-088370 | A | | 3/2000 |
| JP | 2005-337700 | A | | 12/2005 |
| JP | 2009-216296 | A | | 9/2009 |
| JP | 2009270747 | A | * | 11/2009 |
| JP | 2010-014349 | A | | 1/2010 |
| WO | WO 96/20378 | A1 | | 12/2005 |

* cited by examiner

REFRIGERATOR AND DRIVING METHOD THEREOF

CROSS-REFERENCE TO RELATED APPLICATION

The present disclosure relates to subject matters contained in priority Korean Application Nos. 10-2010-0073048, 10-2010-0073047 and 10-2010-0073045, all filed on Jul. 28, 2010, which are herein expressly incorporated by reference in their entireties.

BACKGROUND OF THE INVENTION

1. Field of the Invention

This specification relates to a refrigerator and a method for driving the same, and particularly, to a refrigerator having a refrigeration cycle with a plurality of compressors and evaporators, and a method for driving the same.

2. Background of the Invention

In general, a refrigerator is an apparatus for keeping an inside of the refrigerator at low temperature using a refrigeration cycle having a compressor, a condenser, an expansion apparatus and an evaporator. The compressor of the refrigerator is lubricated using oil for protection from a mechanical friction, and the oil within the compressor is allowed to circulate a refrigeration cycle forming a closed loop together with high temperature and high pressure refrigerant gas discharged out of the compressor.

If such oil is aggregated (accumulated) in the condenser, the evaporator and pipes of the refrigeration cycle, the performance of the refrigeration cycle may be lowered. If the oil does not smoothly flow back into the compressor, the lack of oil within the compressor may be caused, resulting in a damage of the compressor.

The refrigeration cycle applied to the refrigerator may be classified, according to the number of compressors and evaporators, into an 1Eva-cycle having a single compressor and a single evaporator, a parallel 2Eva cycle in which a plurality of evaporators are connected in parallel to an inlet of a single compressor, a 1Comp 2Stage cycle in which a plurality of evaporators are connected to a single 2-stage compressor, a serial cycle in which a plurality of evaporators are connected to the single compressor in series, a bypass serial cycle in which a plurality of evaporators are selectively connected to a single compressor in series.

SUMMARY OF THE INVENTION

The refrigerator having such the refrigeration cycle has the following problems.

First, when one evaporator is connected to one compressor, a refrigerating chamber is overcooled and thereby power consumption is increased.

Second, when a plurality of evaporators are connected to one compressor in parallel or in series, the refrigerating chamber and the freezing chamber can be separately driven, which allows power consumption to be lowered to some degree. However, the power consumption is still increased as compared with required cooling capability and additionally the two-stage compressor makes it difficult to construct the refrigeration cycle including the compressor.

Therefore, an aspect of the detailed description is to provide a refrigerator capable of reducing power consumption, with simultaneously driving a freezing chamber and a refrigerating chamber, and facilitating construction of a refrigeration cycle, and a driving method thereof.

To achieve these and other advantages and in accordance with the purpose of this specification, as embodied and broadly described herein, a refrigerator may include a primary compressor, a secondary compressor connected to an outlet side of the primary compressor and configured to perform a secondary compression for a refrigerant primarily compressed in the primary compressor, a condenser connected to an outlet side of the secondary compressor, a first evaporator diverged from the condenser and connected to an inlet side of the primary compressor, a second evaporator diverged from the condenser together with the first evaporator and connected between the outlet side of the primary compressor and the inlet side of the secondary compressor, and a refrigerant switching valve installed such that an inlet side of the first evaporator and an inlet side of the second evaporator are connected to an outlet side of the condenser in parallel and configured to control the refrigerant to flow toward the first evaporator or the second evaporator.

In accordance with one exemplary embodiment, there is provided a driving method for a refrigerator having a refrigeration cycle comprising a plurality of compressors disposed within a refrigerator main body, wherein an outlet side of a primary compressor located at an upstream, based on a flowing direction of a refrigerant, of the plurality of compressors, is connected to an inlet side of a secondary compressor located at a downstream so as to perform a multi-stage compression for the refrigerant. The method may include detecting driving times of the primary and secondary compressors, comparing the detected driving times with a reference time, and stopping the primary compressor and the secondary compressor and opening an oil balancing pipe for connecting the primary compressor and the second compressor when the detected driving times exceed the reference time, while maintaining a closed state of the oil balancing pipe when the detected driving times does not exceed the reference time.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a refrigerator according to the exemplary embodiments, with reference to the accompanying drawings. For the sake of brief description with reference to the drawings, the same or equivalent components will be provided with the same reference numbers, and description thereof will not be repeated.

Figure 1:
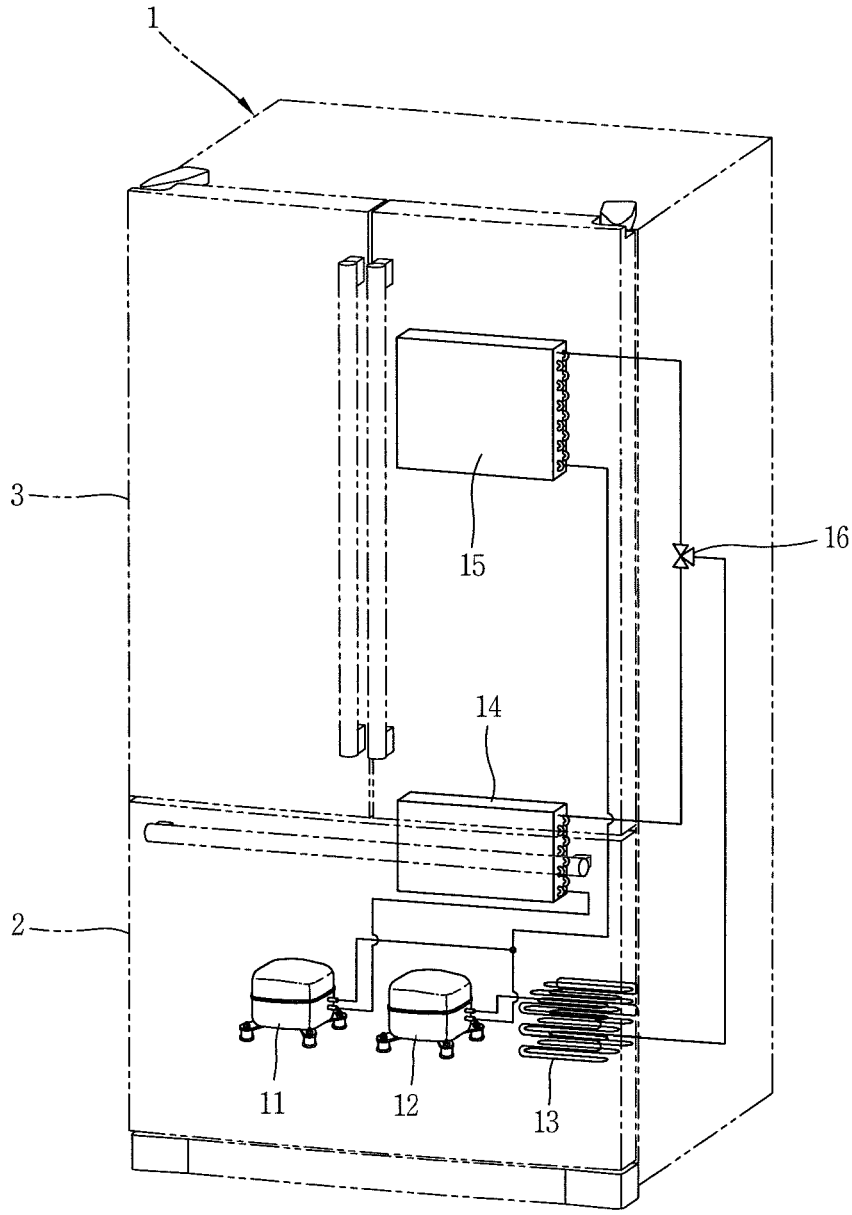
FIG. 1 is a perspective view schematically showing a refrigerator in accordance with the present disclosure.
Figure 2:
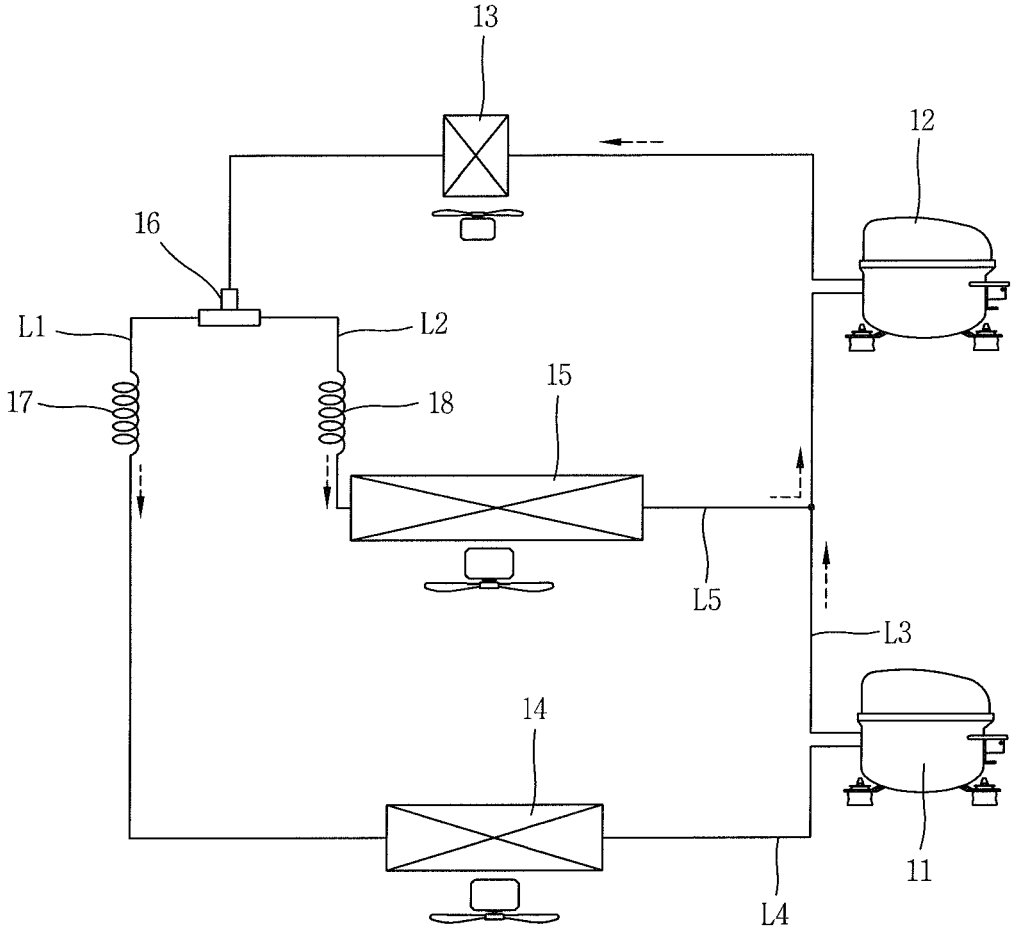
FIG. 2 is a block diagram showing one exemplary embodiment of a refrigeration cycle according to FIG. 1.

FIG. 1 is a perspective view schematically showing a refrigerator in accordance with the present disclosure, and FIG. 2 is a block diagram showing one exemplary embodiment of a refrigeration cycle according to FIG. 1.

As shown in FIGS. 1 and 2, a refrigerator may include a refrigerator main body 1 having a freezing chamber and a refrigerating chamber, and a freezing chamber door 2 and a refrigerating chamber door 3 for opening or closing the freezing chamber and the refrigerating chamber of the refrigerator main body 1, respectively.

A lower side of the refrigerator main body 1 may be shown having a machine chamber, in which a refrigeration cycle for generating cold air is disposed. The refrigeration cycle may be implemented in various configurations according to a type of refrigerator. The refrigeration cycle according to this exemplary embodiment may include a plurality of compressors and a plurality of evaporators and be divided into a freezing chamber refrigeration cycle and a refrigerating chamber refrigeration cycle. The freezing chamber refrigeration cycle may be a closed loop cycle formed by connecting a primary compressor 11, a secondary compressor 12, a condenser 13 and a first evaporator 14, while the refrigerating chamber side refrigeration cycle may be a closed loop cycle formed by connecting the secondary compressor 12, the condenser 13 and a second evaporator 15.

The plurality of compressors 11 and 12 and the condenser 13 may be installed in the machine chamber. The plurality of compressors 11 and 12 may be connected to each other in series. Namely, an outlet of the primary compressor 11 may be connected to an inlet of the secondary compressor 12 such that a refrigerant, which underwent a primary compression in the primary compressor 11, then experiences a secondary compression in the secondary compressor 12. An outlet of the secondary compressor 12 may be connected to an inlet of the condenser 13. The primary and secondary compressors 11 and 12 may be designed to have the same capacity. For a typical refrigerator, a refrigerating chamber driving mode is run more frequently, so it may also be possible that the secondary compressor 12 operatively in association with the refrigerating chamber driving mode, is designed to have a capacity twice larger than that of the primary compressor 11.

The plurality of evaporators 14 and 15 configuring a part of the refrigeration cycle may be connected to each other in parallel by a first branch pipe L1 and a second branch pipe L2 diverged near the outlet of the condenser 13. A refrigerant switching valve 16 for control of a flowing direction of a refrigerant may be installed at the diverged point between the first and second branch pipes L1 and L2. A first expansion apparatus 17 and a second expansion apparatus 18 each for expanding a refrigerant may be installed in the middle of each of the branch pipes L1 and L2, namely, near inlet ends of both evaporators 14 and 15.

One of the plurality of evaporators 14 and 15 may be installed at a rear wall of the freezing chamber and another one may be installed at a rear wall of the refrigerating chamber. The evaporator 14 installed at the freezing chamber (hereinafter, referred to as 'first evaporator') and the evaporator 15 installed at the refrigerating chamber (hereinafter, referred to as 'second evaporator') may have the same capacity. Alternatively, similar to the compressors, the second evaporator 15 may have a larger capacity than the first evaporator 14.

The refrigerant switching valve 16 may be implemented as a 3-way valve. For example, the refrigerant switching valve 16 may have a structure that the outlet of the condenser selectively communicates with one of the evaporators or simultaneously communicates with both the evaporators.

The refrigerator having the configuration may have the following operational effects.

That is, the refrigerant switching valve 16 may control the refrigerant to flow toward the first evaporator or the second evaporator according to a driving mode of the refrigerator, thereby implementing a simultaneous driving mode for simultaneously driving the refrigerating chamber and the freezing chamber, a freezing chamber driving mode for driving only the freezing chamber, or a refrigerating chamber driving mode for driving only the refrigerating chamber.

For example, in the simultaneous driving mode of the refrigerator, the refrigerant switching valve 16 is all open such that a refrigerant can circulate the freezing chamber refrigeration cycle and the refrigerating chamber refrigeration cycle. That is, a refrigerant flowed through the condenser 13 may flow by being distributed into the first evaporator 14 and the second evaporator 15. Simultaneously, the primary compressor 11 and the secondary compressor 12 start to be driven.

Accordingly, a refrigerant, which is sucked into the primary compressor 11 via the first evaporator 14, experiences a primary compression in the primary compressor 11. The primarily compressed refrigerant, which is discharged out of the primary compressor 11, is introduced into the secondary compressor 12. Here, a refrigerant, which flows through the second evaporator 15, is mixed with the primarily compressed refrigerant discharged out of the primary compressor 11, thereby being introduced into the secondary compressor 12.

The primarily compressed refrigerant and the refrigerant flowed through the second evaporator 12 are compressed in the secondary compressor 12 and discharged. The refrigerant discharged out of the secondary compressor 12 flows into the condenser 13 to be condensed. The condensed refrigerant in the condenser 13 is re-distributed toward the first evaporator 14 and the second evaporator 15 by means of the refrigerant switching valve 16 for circulation. Such series of processes are repeated.

On the other hand, when the refrigerator is in the freezing chamber driving mode, the refrigerant switching valve 16 blocks the direction toward the second evaporator 15 as the refrigerating chamber refrigeration cycle, and opens only the direction toward the first evaporator 14 as the freezing chamber refrigeration cycle, such that a refrigerant flowed through the condenser 13 can move toward the first evaporator 14. However, the primary compressor 11 and the secondary compressor 12 are driven simultaneously. Accordingly, the refrigerant flowed through the first evaporator 14 can circulate with being primarily and secondarily compressed sequentially via the primary and secondary compressors 11 and 12.

When the refrigerator is in the refrigerating chamber driving mode, the refrigerant switching valve 16 blocks the direction toward the first evaporator 14 as the freezing chamber refrigeration cycle and opens the direction toward the second evaporator 15 as the refrigerating chamber refrigeration cycle. Also, only the secondary compressor 12 starts to be driven with the primary compressor 11 stopped.

Accordingly, a refrigerant flowed through the condenser 13 flows only toward the second evaporator 15 to be introduced into the secondary compressor 12. The refrigerant, which is discharged after being compressed in the secondary compressor 12, flows into the condenser 13 to be condensed. Such series of processes are repeated.

Consequently, the refrigerator can be driven with the refrigeration cycles, which are independently run in correspondence with the load of the freezing chamber or the refrigerating chamber, which allows reduction of unnecessary power consumption of the refrigerator, thereby remarkably improving efficiency of the refrigerator.

Hereinafter, description will be given of another exemplary embodiment.

Figure 3:
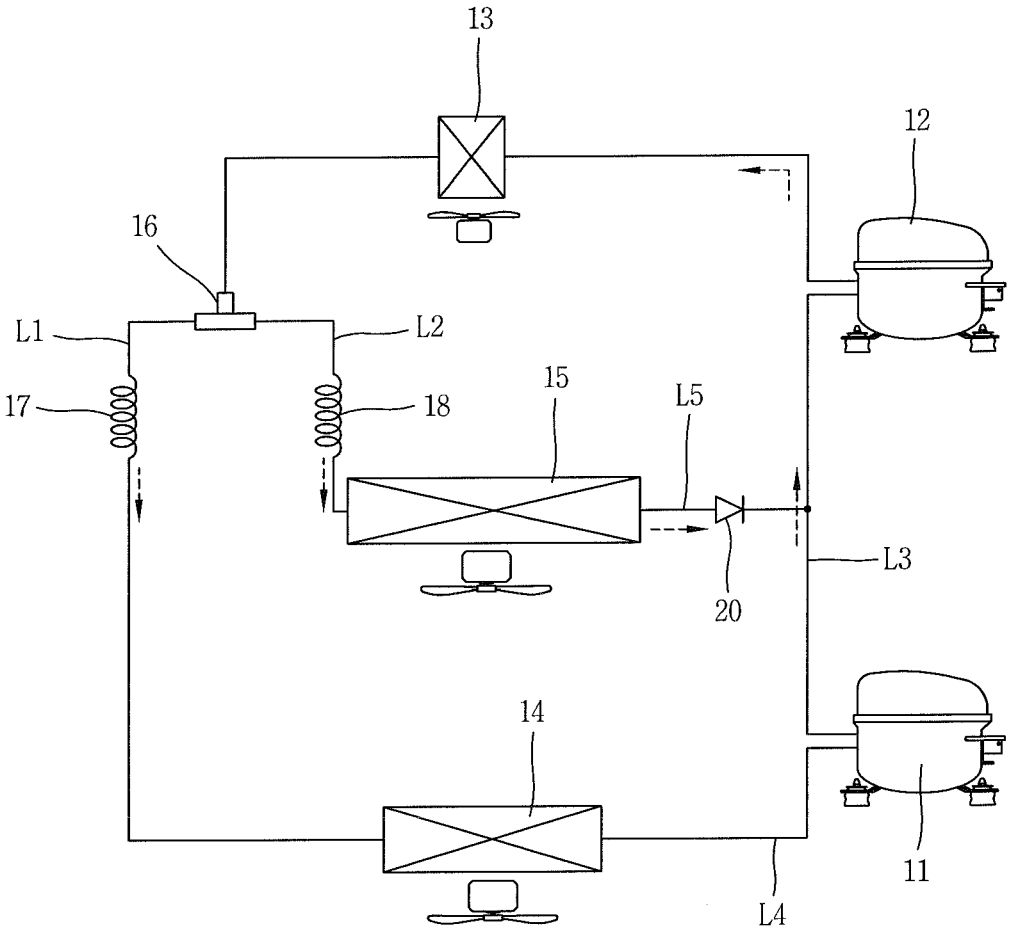
FIG. 3 is a block diagram showing another exemplary embodiment of the refrigeration cycle of FIG. 1.

FIG. 3 is a block diagram showing another exemplary embodiment of the refrigeration cycle of FIG. 1.

As shown in FIG. 3, in this exemplary embodiment, a backflow prevention valve 20 may be installed between a pipe L3 connected to an outlet of the primary compressor 11 and a pipe L5 connected to an outlet of the second evaporator 15. The backflow prevention valve 20 may prevent a refrigerant discharged out of the primary compressor 11 from being reversely flowing toward the second evaporator 15 due to a pressure difference.

The backflow prevention valve 20 may be implemented as a check valve which is mechanically operated by pressure of a refrigerant. Although not shown, it may alternatively be implemented as a solenoid valve which is cooperative with the refrigerant switching valve 16.

The basic configuration of the refrigeration cycle for the refrigerator according to this another exemplary embodiment is the same as or similar to that of the previous exemplary embodiment, so detailed description thereof will be omitted.

Here, the another exemplary embodiment may have the following operational effects. For example, pressure of a refrigerant, which is discharged after compressed in the primary compressor 11, may be higher than pressure of a refrigerant, which is introduced into the secondary compressor 12 via the second evaporator 15. Accordingly, a part of the refrigerant discharged out of the primary compressor 12 may be prone to reverse flow toward the second evaporator 15 before being introduced into the secondary compressor 12. When the refrigerant discharged out of the primary compressor 11 reversely flows into the second evaporator 15, temperature of a refrigerant within the second evaporator 15 may be increased. Then, upon initiating a driving mode that the second evaporator 15 is driven, namely, in the refrigerating chamber driving mode, the refrigerant introduced from the second evaporator 15 into the secondary compressor 12 is increased in temperature, which causes an increase in power consumption within the secondary compressor 12, thereby lowering the performance of the refrigerator.

However, as shown in the another exemplary embodiment, as the backflow prevention valve 20 as a unidirectional check valve is installed at the outlet side pipe L5 of the second evaporator 15, the refrigerant discharged out of the primary compressor 11 can be prevented from flowing reversely into the second evaporator 15. Hence, preheat of the refrigerant present in the second evaporator 15 can be prevented, accordingly, an increase in power consumption of the refrigerator, which is caused due to an increased pressure of the secondary compressor 12 caused by the increase in the temperature of the refrigerant introduced into the secondary compressor 12, can be obviated even through the refrigerating chamber driving mode that a refrigerating chamber fan is run is started later.

Consequently, upon simultaneous driving of the primary and secondary compressors, the refrigerant, which is discharged after primarily compressed in the primary compressor, can be prevented from flowing reversely into the second evaporator, which is under relatively low pressure. This can prevent preheat of the refrigerant contained within the second evaporator, accordingly, an increase in pressure of the secondary compressor when the refrigerating chamber driving mode is initiated later can be obviated, resulting in improvement of efficiency of the refrigerator.

Hereinafter, description will be given of another exemplary embodiment of a refrigeration cycle.

Figure 4:
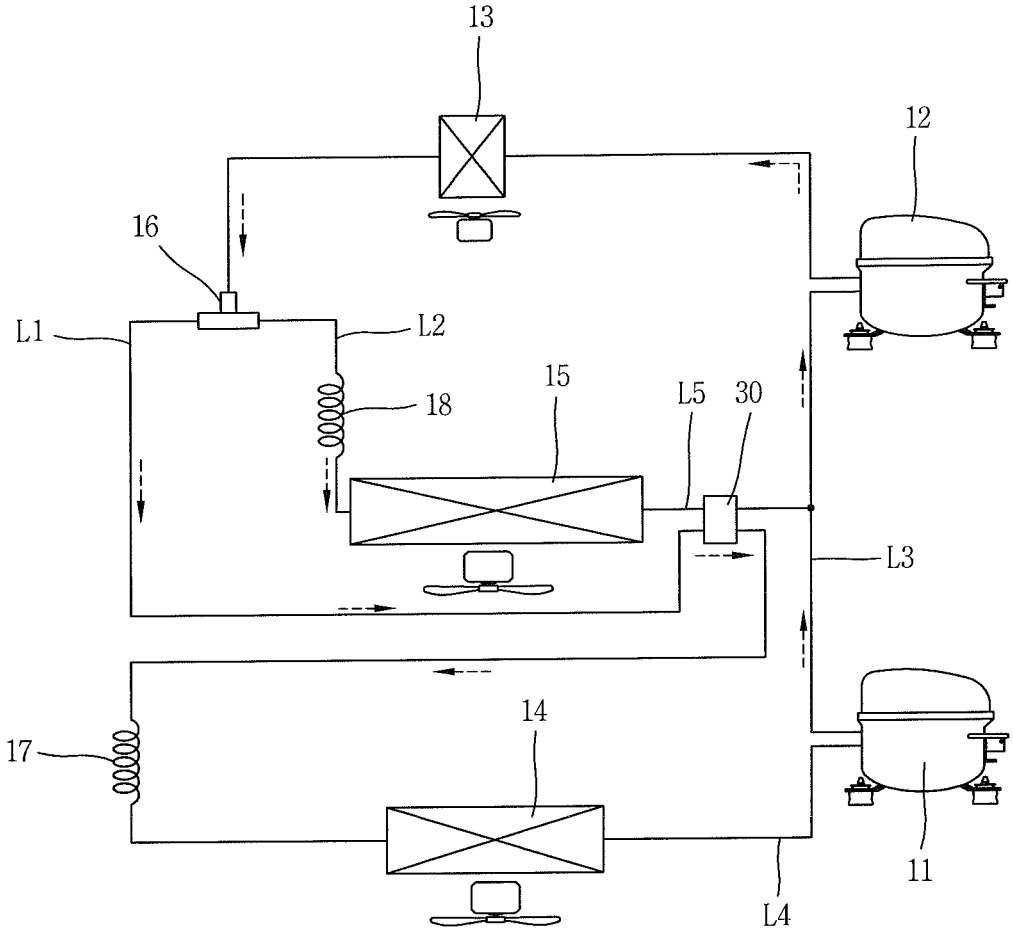
FIG. 4 is a block diagram showing another exemplary embodiment of the refrigeration cycle of FIG. 1.

FIG. 4 is a block diagram showing another exemplary embodiment of the refrigeration cycle of FIG. 1.

That is, the previous exemplary embodiment illustrates that the backflow prevention valve 20 is installed at the outlet side of the second evaporator 15 to prevent the primarily compressed refrigerant discharged from the primary compressor 11 from flowing reversely into the second evaporator 15 connected to the inlet side of the secondary compressor 12, whereas this exemplary embodiment, as shown in FIG. 4, illustrates that an injection unit for allowing heat exchange between a refrigerant introduced into an evaporator exhibiting low evaporation temperature and a refrigerant flowed through another evaporator exhibiting high evaporation temperature, of the first and second evaporators 14 and 15.

The injection unit may be implemented by installing an auxiliary heat exchanger 30 at a pipe L5 connected to the outlet of the second evaporator 15 and coupling the first branch pipe L1, to which the first evaporator 14 is connected, to the auxiliary heat exchanger 30 to be heat-exchanged with each other.

The auxiliary heat exchanger 30 may have various structures, such as a dual-pipe heat exchanger structure with excellent heat exchanging performance, a plate type heat exchanger structure, or the like.

The refrigeration cycle for the refrigerator according to this exemplary embodiment is the same as or similar to the previous embodiment in view of the basic configuration and operational effects. Here, in accordance with this exemplary embodiment, a refrigerant, which flows toward the first evaporator 14 by means of the refrigerant switching valve 16, first passes through the auxiliary heat exchanger 30 and then is introduced into the first evaporator 14, so as to increase temperature of the first evaporator 14. Since the second evaporator 15 exhibits a relatively high refrigerant flow and high evaporation temperature, compared with the first evaporator 14, an effect of shifting a load of the freezing chamber to the refrigerating chamber may be obtained, thereby improving an entire efficiency of the refrigerator.

In the meantime, in regard of the 2stage-2comp refrigeration cycle, when the refrigerating chamber driving mode is frequently executed, the freezing chamber driving is unable for a long term of time, accordingly, a refrigerant may not be introduced into the primary compressor connected to a freezing chamber evaporator, which reduces a mixed amount of refrigerant and oil. As a result, a uniform oil amount may not be maintained between the compressors, which may cause a breakdown of the compressors. Also, even in the simultaneous driving mode, if the refrigerant distribution between the freezing chamber and the refrigerating chamber is interrupted, a refrigerant and oil may be accumulated (biased) in any one side, which may cause an unbalance of the oil amount between the compressors, consequently resulting in the breakdown of the compressors.

To address such problems, it may be preferable to keep balancing the oil amount among a plurality of compressors in a refrigeration cycle having a plurality of compressors and a plurality of evaporators.

Figure 5:
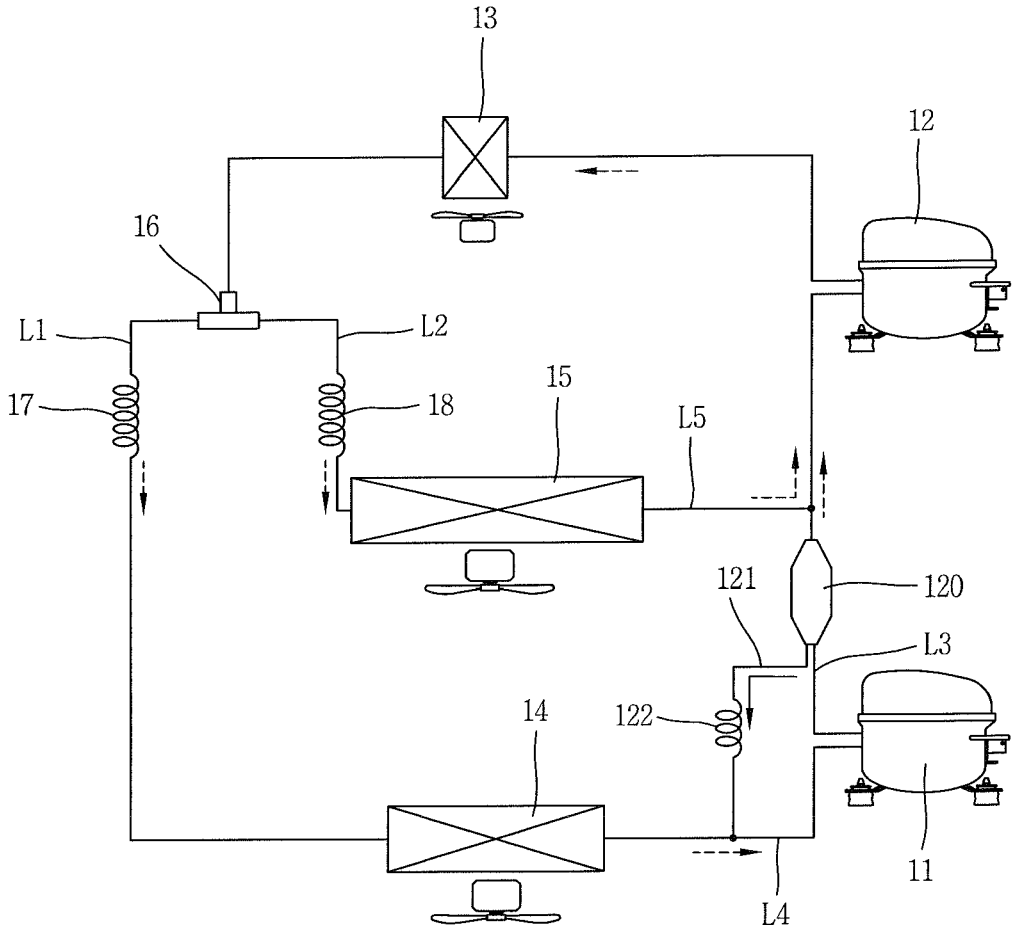
FIG. 5 is a block diagram showing one exemplary embodiment of an oil balancing unit provided in the refrigeration cycle of FIG. 1.
Figure 6:
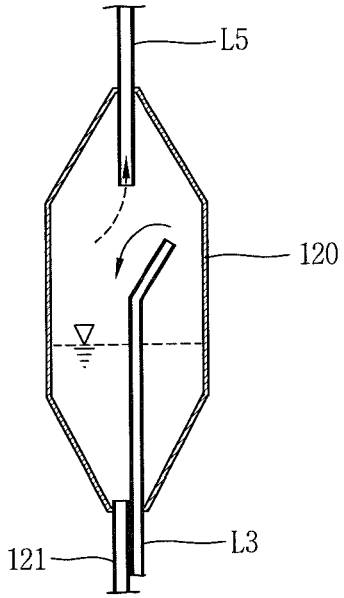
FIG. 6 is a schematic view showing an oil separator according to FIG. 5.

FIG. 5 is a block diagram showing one exemplary embodiment of an oil balancing unit provided in the refrigeration cycle of FIG. 1, and FIG. 6 is a schematic view showing an oil separator according to FIG. 5.

As shown in FIG. 5, an oil balancing unit in accordance with this exemplary embodiment may include an oil separator 120 installed at the pipe L3 connected to the outlet of the primary compressor 11 for separating oil from a refrigerant discharged out of the primary compressor 11, and an oil collection pipe 121 connected between an oil outlet of the oil separator 120 and the pipe L4 connected to the inlet of the primary compressor 11.

The oil separator 120, as shown in FIG. 6, may be installed long in an up-and-down direction. The pipe L3 connected to the outlet of the primary compressor 11 may be connected to a lower end of the oil separator 120 by being inserted as deep as a predetermined height, and a pipe L5 connected to the inlet of the secondary compressor 12 may be coupled to an upper end of the oil separator 120.

A capillary pipe 122 for decompressing collected oil may be connected in the middle of the oil collection pipe 121.

Here, in the simultaneous driving mode in which the primary compressor and the secondary compressor are simultaneously driven or a freezing chamber driving mode, a refrigerant discharged out of the primary compressor 11 may contain a certain amount of oil. However, this oil can be separated from the refrigerant while passing through the oil separator 120 in the mixed state with the refrigerant. The separated oil in the oil separator 120 may then be collected into the primary compressor 11 via the oil collection pipe 121 while the refrigerant may be introduced into the secondary compressor 12 to be secondarily compressed.

As such, the primary compressor 11 can always contain a certain amount of oil, thereby minimizing or obviating a compressor breakdown or damage due to the lack of oil within the primary compressor 11 and balancing the oil amount between the primary compressor 11 and the secondary compressor 12.

Hereinafter, description will be given of another exemplary embodiment of an oil balancing unit.

Figure 7:
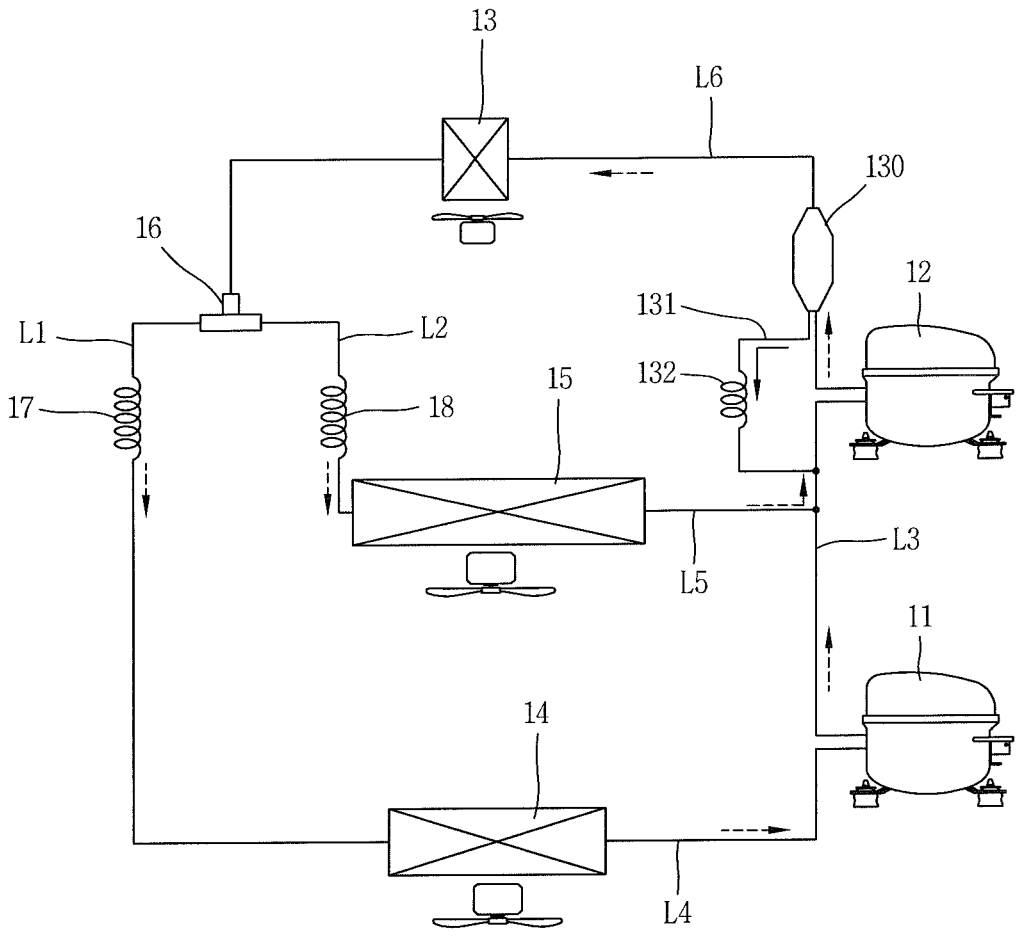
FIGS. 7 to 9 are block diagrams showing another exemplary embodiments an oil balancing unit provided in the refrigeration cycle of FIG. 1.

FIG. 7 is a block diagram showing another exemplary embodiment of an oil balancing unit of the refrigeration cycle of FIG. 1.

That is, the previous exemplary embodiment illustrates the oil separator is located near the outlet of the primary compressor, whereas this exemplary embodiment, as shown in FIG. 7, illustrates that an oil separator 130 constructing a part of the oil balancing unit is installed at a pipe L6 connected to the outlet of the secondary compressor 12.

Here, the oil collection pipe 131 may have an outlet connected to a pipe at the inlet side of the secondary compressor 12, namely, the pipe L3 connected to the outlet of the primary compressor 11. This exemplary embodiment has the same as or similar to the previous exemplary embodiment in view of the basic configuration and operational effects. Here, the lack of oil in the secondary compressor 12, which may be caused due to a frequent driving of the refrigerating chamber of the refrigerator, can be obviated and simultaneously the oil can be balanced between the primary compressor 11 and the secondary compressor 12. An unexplained reference numeral 132 in FIG. 7 denotes a capillary pipe.

Hereinafter, another exemplary embodiment of the oil balancing unit will be described.

Figure 8:
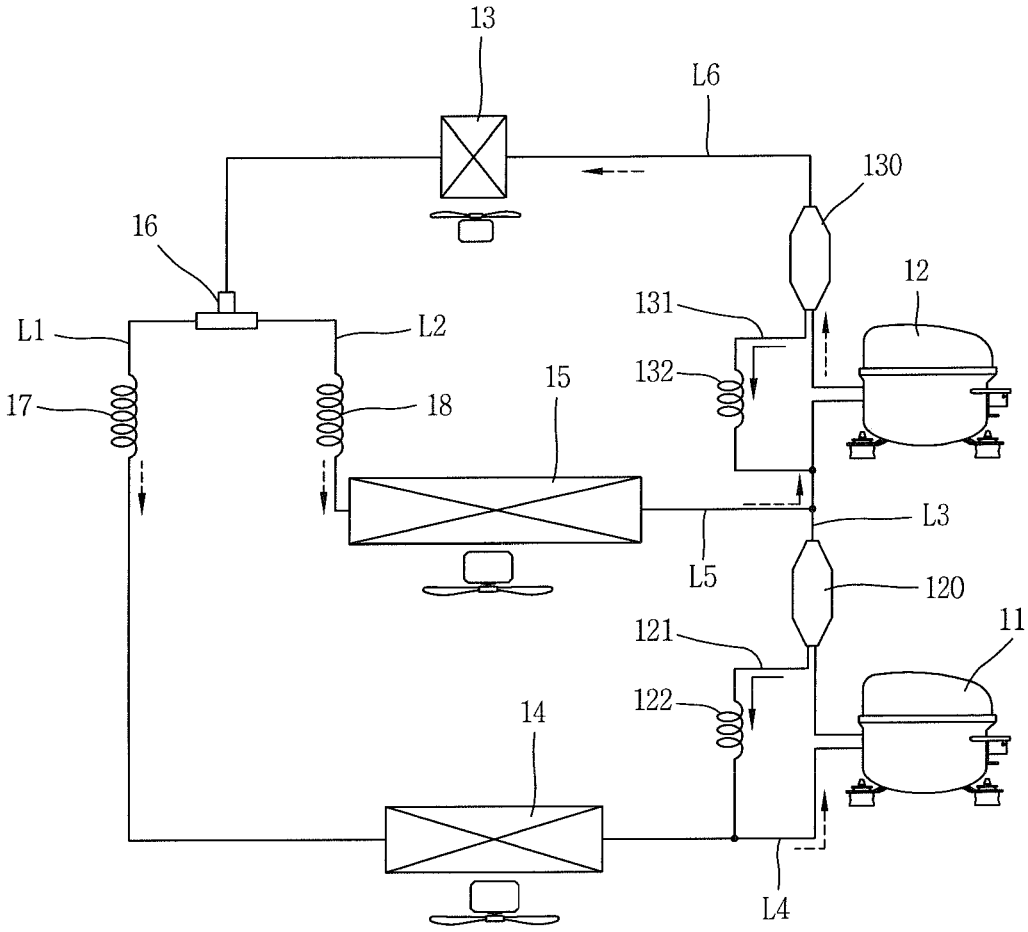

FIG. 8 is a block diagram showing another exemplary embodiment of an oil balancing unit of the refrigeration cycle of FIG. 1.

That is, the previous exemplary embodiments illustrate that one oil separator is located at the pipe connected to the outlet of the primary compressor or the pipe connected to the outlet of the secondary compressor, whereas this exemplary embodiment, as shown in FIG. 8, illustrates that the oil separator constructing the oil balancing unit includes a first oil separator 120 and a second oil separator 130. The first oil separator 120 may be installed at the pipe L3 connected to the outlet of the primary compressor 11 and the second oil separator 130 may be installed at the pipe L6 connected to the outlet of the secondary compressor 12. An outlet of a first oil collection pipe 121 connected to the first oil separator 120 may be connected to the pipe L4, which is connected to the inlet of the primary compressor 11, and an outlet of a second oil collection pipe 131 connected to the second oil separator 130 may be connected to the pipe L5, which is connected to the inlet of the secondary compressor 12. Unexplained reference numerals 122 and 132 in FIG. 8 denote capillary pipes.

In this exemplary embodiment, the basic configuration and the operational effects are also the same as or similar to those of the previous exemplary embodiments. Here, in this exemplary embodiment, the first oil separator 120 and the second oil separator 130 may be installed at the pipes L3 and L6 connected to the outlets of the compressors 11 and 12, respectively, and oil separated in each oil separator 120, 130 can be collected into the inlet of each compressor 11, 12, whereby the lack of oil in each compressor can effectively be obviated.

Hereinafter, another exemplary embodiment of an oil balancing unit will be described.

Figure 9:
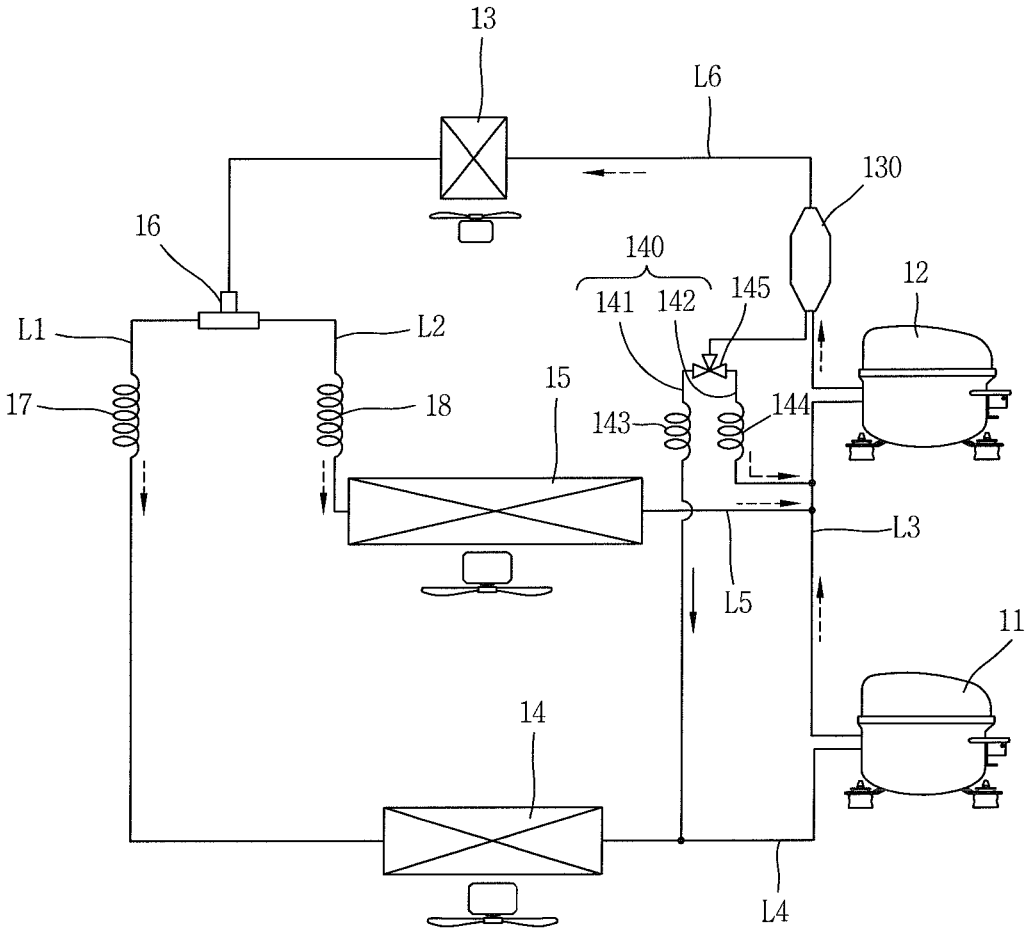

FIG. 9 is a block diagram showing another exemplary embodiment of an oil balancing unit of the refrigeration cycle of FIG. 1.

That is, the previous exemplary embodiments illustrate the cases that the oil separator is installed at the outlet side of the primary or secondary compressor and the case that the oil separator is installed at the inlet side of the primary or secondary compressor, whereas this exemplary embodiment, as shown in FIG. 9, an oil separator 130 constructing a part of the oil balancing unit is installed at the pipe L6 connected to the outlet of the secondary compressor 12 and an oil collection pipe 140 is diverged into a first oil collection pipe 141 and a second oil collection pipe 142 such that the first oil collection pipe 141 is connected to the pipe L4 connected to the inlet of the primary compressor 11 and the second oil collection pipe 142 is connected to the pipe L5 connected to the inlet of the secondary compressor 12.

Here, when the outlets of the first and second oil collection pipes 141 and 142 are connected respectively to the pipe L4 connected to the inlet of the primary compressor 11 and the pipe L5 connected to the inlet of the secondary compressor 12, an oil switching valve 145 implemented as a 3-way valve may be installed at the diverged point of the first and second oil collection pipes 141 and 142.

This exemplary embodiment is the same as or similar to the previous exemplary embodiments in view of the basic configuration and operational effects of the refrigerator, so detailed description thereof will be omitted. Here, in accordance with this exemplary embodiment, as the oil separator 130 is installed near the inlet of the condenser 13, it can separate oil discharged out of the secondary compressor 12 as well as the primary compressor 11, and the separated oil can be collected toward the inlet of an appropriate compressor using the oil switching valve 145, thereby more balancing the oil amount between the primary compressor 11 and the secondary compressor 12. Also, this exemplary embodiment is configured such that the single oil separator 130 is used to allow supplying of the collected oil into the primary and secondary compressors 11 and 12, thereby reducing a fabricating cost required for installation of the oil separator.

Meanwhile, the foregoing exemplary embodiments illustrate that the oil balancing unit is configured to install the oil separator in the middle of the pipe and connect the oil separator and each pipe to each other via the oil collection pipes to collect oil separated in the oil separator into the inlet of each compressor. Alternatively, the oil balancing unit may directly connect the primary compressor and the secondary compressor to each other.

Figure 10:
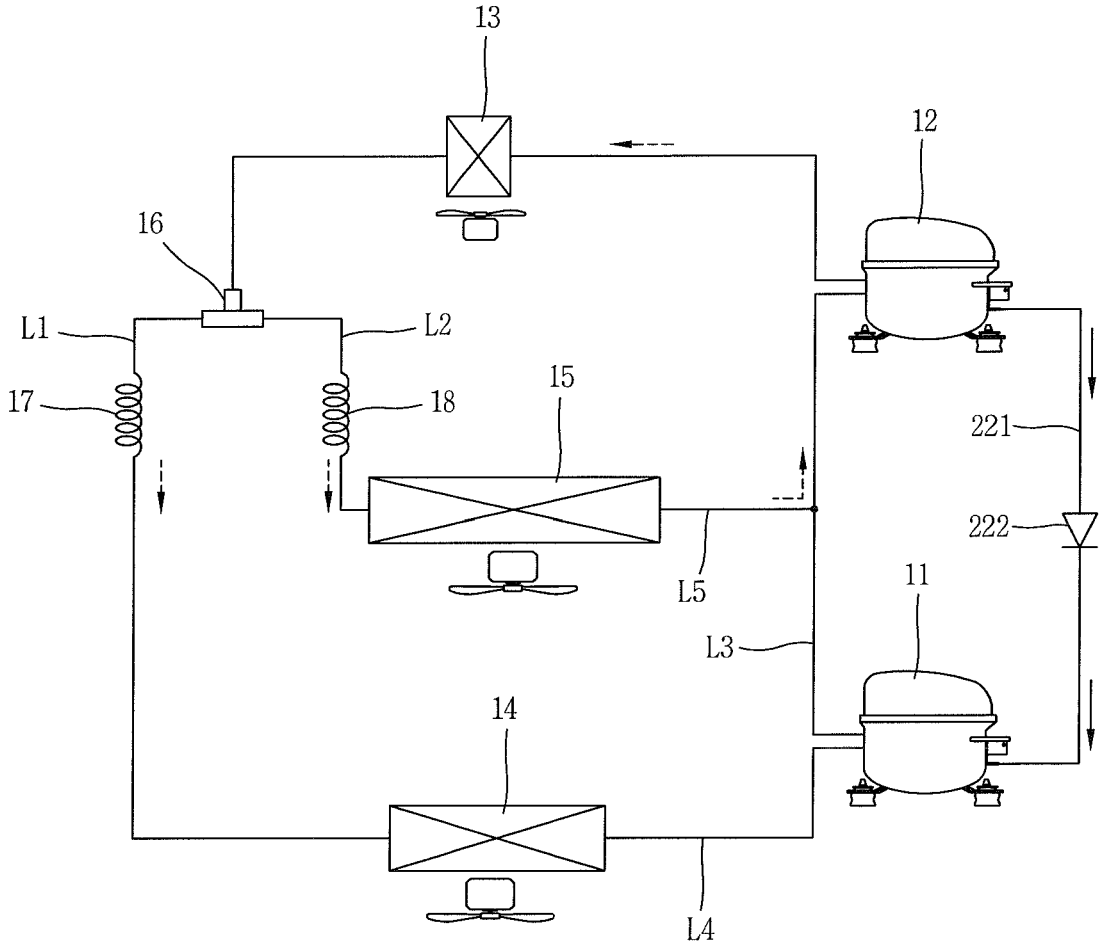
FIG. 10 is a block diagram showing another exemplary embodiment of an oil balancing unit provided in the refrigeration cycle of FIG. 1.
Figure 11:
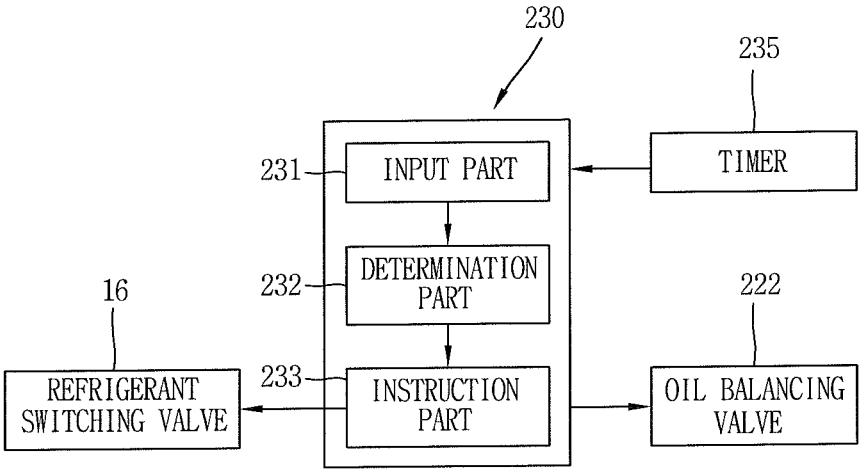
FIGS. 11 and 12 are schematic views showing exemplary embodiments of a control unit for the refrigeration cycle of FIG. 10.
Figure 12:
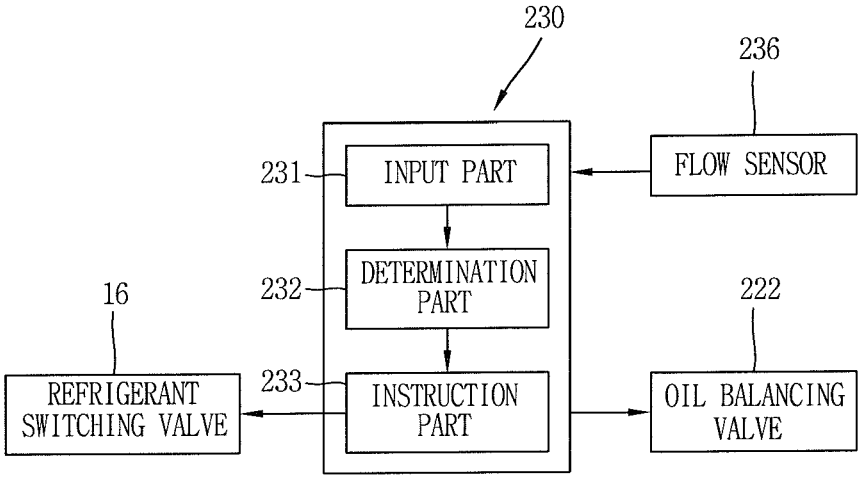
Figure 13:
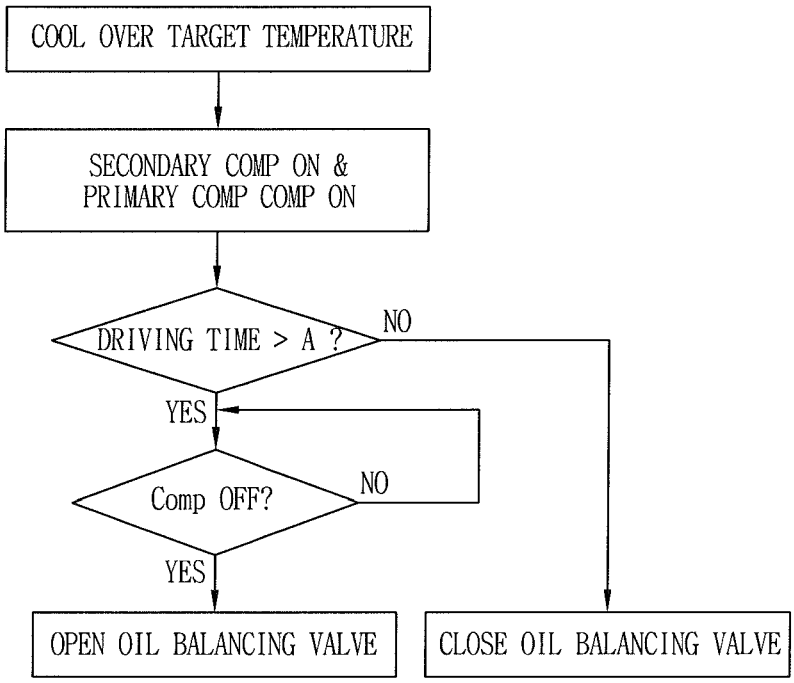
FIG. 13 is a block diagram showing an oil balancing process in the refrigeration cycle of FIG. 10.

FIG. 10 is a block diagram showing another exemplary embodiment of an oil balancing unit of the refrigeration cycle of FIG. 1, FIGS. 11 and 12 are block diagrams showing exemplary embodiments of a control unit for the refrigeration cycle according to FIG. 10, and FIG. 13 is a block diagram showing an oil balancing process in the refrigeration cycle of FIG. 10.

As shown in FIGS. 10 to 13, an oil balancing pipe 221 may be connected between the primary compressor 11 and the secondary compressor 12, and an oil balancing valve 222 may be installed in the middle of the oil balancing pipe 221 for opening or closing the oil balancing pipe 221.

The oil balancing valve 222 may be implemented as a solenoid valve or a stepping motor valve and connected to a control unit 230 for automatically opening or closing the oil balancing valve 222.

The control unit 230, as shown in FIG. 11, may include a timer 235 for detecting a driving time of the primary compressor 11 or the secondary compressor 12 of the plurality of compressors. The control unit 230 may be configured to open or close the oil balancing valve 222 by comparing the driving time of the corresponding compressor detected by the timer 235 with a reference time. For example, the control unit 230 may include an input part 231 for receiving a driving time of the corresponding compressor detected by the timer 235, a determination part 232 for determining whether to open or close the oil balancing valve 222 by comparing the received driving time with a reference time, and an instruction part 233 for controlling the oil balancing valve 222 according to the determination of the determination part 232.

Referring to FIG. 12, a flow sensor 236 may be installed at the primary or secondary compressor 11 or 12 or both of the compressors, accordingly, the oil balancing valve 222 may be open or closed according to a detection value by the flow sensor 236. This case also has the same or similar basic configuration and operational effects to the case of employing the timer. Here, in accordance with this exemplary embodiment, each flow of the compressors may be directly detected and compared to control the oil balancing valve, thereby achieving an accurate oil balancing of both of the compressors.

The oil balancing unit may have the following operational effects.

That is, in the simultaneous driving mode in which the primary and secondary compressors 11 and 12 are run simultaneously or in the freezing chamber driving mode, referring to FIG. 13, the timer 235 measures the driving time of each of the primary and secondary compressors 11 and 12 in real time. When the driving time of each of the primary compressor 11 and the secondary compressor 12 reaches a reference time, the control unit 230 may open the oil balancing valve 222 to supply oil contained in the secondary compressor 12 into the primary compressor 11, namely, perform a so-called oil balancing operation.

Here, the input part 231 may receive a current inner temperature of the refrigerator in real time via a temperature sensor (not shown) for measuring the inner temperature of the refrigerator prior to stopping the primary and secondary compressors 11 and 12. The determination part 232 may calculate a difference between the inner temperature of the refrigerator, transferred by the input part 231, and a target temperature so as to determine whether to execute an additional operation of the refrigerator. When determined the additional operation is needed, the instruction part 233 may instruct execution of the additional operation to reduce the inner temperature of the refrigerator to be lower than the target temperature by a preset value.

Consequently, suction pressure of the secondary compressor is higher than that of the primary compressor, so oil can be supplied from the secondary compressor to the primary compressor using the pressure difference between the primary and secondary compressors without running the secondary compressor.

Therefore, the lack of oil which may occur in the primary compressor can be obviated, which allows preventing of the breakdown of the compressors and simultaneously ensuring of a driving time of the refrigerator, resulting in minimization or prevention of power consumption and improvement of efficiency of the refrigerator.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a primary compressor;

a secondary compressor connected to an outlet side pipe of the primary compressor and configured to perform a secondary compression for a refrigerant primarily compressed in the primary compressor;

a condenser connected to an outlet side pipe of the secondary compressor;

a first evaporator diverged from the condenser and connected to an inlet side pipe of the primary compressor;

a second evaporator diverged from the condenser together with the first evaporator and connected between the outlet side pipe of the primary compressor and an inlet side pipe of the secondary compressor;

a refrigerant switching valve installed such that an inlet side of the first evaporator and an inlet side of the second evaporator are connected to an outlet side of the condenser in parallel and configured to control the refrigerant to flow toward the first evaporator or the second evaporator; and an oil balancing unit having at least one path to allow oil to be transferred from a compressor containing more oil to another compressor containing less oil of the plurality of compressors, wherein the oil balancing unit comprises an oil separating portion configured to separate oil from a refrigerant, and an oil collecting portion configured to collect the oil separated in the oil separating portion into the corresponding compressor, wherein the oil separating portion is located between an outlet side pipe of the secondary compressor and an inlet side pipe of the condenser, wherein the oil collecting portion has a first outlet connected between the inlet side pipe of the primary compressor and the outlet pipe of the first evaporator and a second outlet connected between the inlet side pipe of the secondary compressor and the outlet of the second evaporator, wherein the oil collecting portion has inlets connected to the oil separating portion via a valve configured to selectively open or close a corresponding outlet, and wherein the valve is a three-way valve having an inlet connected to the oil separating portion, and outlets respectively connected to the inlets of the oil collecting portion.

2. The refrigerator of claim 1, wherein the first evaporator forms a freezing chamber refrigeration cycle for supplying cold air into the freezing chamber, and the second evaporator forms a refrigerating chamber refrigeration cycle for supplying cold air into the refrigerating chamber.

3. The refrigerator of claim 1, wherein the oil separating portion is installed between the outlet side pipe of the primary compressor and the inlet side pipe of the secondary compressor, and wherein the oil collecting portion has an outlet connected to the inlet side of the primary compressor.

4. The refrigerator of claim 1, wherein the oil balancing unit further comprises an oil decompressing unit installed in the middle of the oil collecting portion and configured to decompress the collected oil.

5. A refrigerator comprising:

a primary compressor;

a secondary compressor connected to an outlet side pipe of the primary compressor and configured to perform a secondary compression for a refrigerant primarily compressed in the primary compressor;

a condenser connected to an outlet side pipe of the secondary compressor;

a first evaporator diverged from the condenser and connected to an inlet side of the primary compressor;

a second evaporator diverged from the condenser together with the first evaporator and connected between the outlet side pipe of the primary compressor and an inlet side pipe of the secondary compressor;

a refrigerant switching valve installed such that an inlet side of the first evaporator and an inlet side of the second evaporator are connected to an outlet side of the condenser in parallel and configured to control the refrigerant to flow toward the first evaporator or the second evaporator; and an oil balancing unit having at least one path to allow oil of a compressor with high suction pressure to flow into another compressor with low suction pressure, wherein the oil balancing unit comprises an oil separating portion configured to separate oil from a refrigerant, and an oil collecting portion configured to collect the oil separated in the oil separating portion into the corresponding compressor, and wherein the oil separating portion is located between an outlet side pipe of the secondary compressor and an inlet side pipe of the condenser, wherein the oil collecting portion has a first outlet connected between the inlet side pipe of the primary compressor and the outlet pipe of the first evaporator and a second outlet connected between the inlet side pipe of the secondary compressor and the outlet of the second evaporator, wherein the oil collecting portion has inlets connected to the oil separating portions via a valve configured to selectively open or close a corresponding outlet, and wherein the valve is a three-way valve having an inlet connected to the oil separating portion, and outlets respectively connected to the inlets of the oil collecting portion.

6. A refrigerator comprising:

a primary compressor;

a secondary compressor connected to an outlet side pipe of the primary compressor and configured to perform a secondary compression for a refrigerant primarily compressed in the primary compressor;

a condenser connected to an outlet side pipe of the secondary compressor;

a first evaporator diverged from the condenser and connected to an inlet side pipe of the primary compressor;

a second evaporator diverged from the condenser together with the first evaporator and connected between the outlet side pipe of the primary compressor and an inlet side pipe of the secondary compressor;

a refrigerant switching valve installed such that an inlet side of the first evaporator and an inlet side of the second evaporator are connected to an outlet side of the condenser in parallel and configured to control the refrigerant to flow toward the first evaporator or the second evaporator; and an oil balancing unit having at least one path to allow flowing of oil of the secondary compressor into the primary compressor, wherein the oil balancing unit comprises an oil separating portion configured to separate oil from a refrigerant, and an oil collecting portion configured to collect the oil separated in the oil separating portion into the corresponding compressor, and wherein the oil separating portion is located between an outlet side pipe of the secondary compressor and an inlet side pipe of the condenser, wherein the oil collecting portion has a first outlet connected between the inlet side pipe of the primary compressor and the outlet pipe of the first evaporator and a second outlet connected between the inlet side pipe of the secondary compressor and the outlet of the second evaporator, wherein the oil collecting portion has inlets connected to the oil separating portions via a valve configured to selectively open or close a corresponding outlet, and wherein the valve is a three-way valve having an inlet connected to the oil separating portion, and outlets respectively connected to the inlets of the oil collecting portion.

* * * * *